US005552097A

United States Patent [19]

Schippers

[11] Patent Number: 5,552,097

[45] Date of Patent: Sep. 3, 1996

[54] METHOD AND APPARATUS FOR HEATING A SYNTHETIC FILAMENT YARN

[75] Inventor: Heinz Schippers, Remscheid, Germany

[73] Assignee: Barmag AG, Remscheid, Germany

[21] Appl. No.: 395,878

[22] Filed: Feb. 28, 1995

[30] Foreign Application Priority Data

Feb. 28, 1994 [DE] Germany ..... 44 06 416.0

[51] Int. Cl.[6] ..... D01D 5/084; D01D 10/02

[52] U.S. Cl. ..... 264/103; 28/240; 264/210.8; 264/211.17; 425/66; 425/378.2; 425/382.2; 425/404

[58] Field of Search ..... 264/103, 210.8, 264/211.14, 211.17; 425/66, 378.2, 382.2, 404; 28/240; 57/310

[56] References Cited

U.S. PATENT DOCUMENTS 4,902,461 2/1990 Schippers ..... 264/103

5,148,666 9/1992 Bauer et al. ..... 57/290

FOREIGN PATENT DOCUMENTS 1660605 7/1971 Germany .

3808854 9/1988 Germany .

64-85306 3/1989 Japan ..... 264/211.17

*Primary Examiner*—Leo B. Tentoni

*Attorney, Agent, or Firm*—Bell, Seltzer, Park & Gibson, P.A.

[57] ABSTRACT

A method and an apparatus for heating and drawing a synthetic filament yarn, and wherein the yarn receives a film of water by wetting with heated water vapor before entering into a heating chamber and so that the water vapor initially condenses on the yarn as it enters the heating chamber. To this end, a water nozzle or a hot vapor nozzle may be used, which is arranged upstream of the heating chamber.

16 Claims, 4 Drawing Sheets

METHOD AND APPARATUS FOR HEATING A SYNTHETIC FILAMENT YARN

BACKGROUND OF THE INVENTION

The invention relates to a method and apparatus for the production of a synthetic filament yarn and which includes advancing a freshly spun yarn through an elongate heating chamber.

DE-A 38 08 854 discloses a yarn heating process wherein a freshly spun synthetic filament yarn is advanced at a high speed through a heating tube while it is being drawn. To obtain high speeds, it is also necessary to apply high temperatures.

It is the object of the present invention to prevent or lessen chemophysical reactions of the yarn material in the thermal treatment of an advancing synthetic filament yarn, which may for example consist of polyester, polyamide, nylon, and polypropylene filaments. It is intended to prevent such reactions, which result in an increased amount of contamination in the heater and on the yarn, as well as on subsequent yarn guide elements, in discoloration of the yarn material, shrinkage, or other disadvantageous consequences, or which adversely affect the capacity of the yarn to absorb spin finishes, adhesives, and dyes that are applied.

SUMMARY OF THE INVENTION

The above and other objects and advantages are achieved by the provision of a method and apparatus which includes the steps of extruding a polymeric material so as to form a plurality of advancing filaments, gathering the extruded filaments so as to form an advancing yarn, guiding the advancing yarn through an elongate heating chamber, and applying heated water vapor to the advancing yarn immediately prior to its entry into the heating chamber so that the water vapor condenses on the yarn as it enters into the heating chamber.

The invention takes advantage of the fact that organic yarn materials, e.g., polyester, polypropylene, and in particular nylon and Perlon™, absorb the water vapor molecules in their structure. This tends to prevent chemophysical changes, in that the water molecules inhibit a tendency to shrinkage and yellowing, and they promote absorbency or adhesion for other yarn treatment materials, which are applied to the yarn in a later stage of processing, such as, for example, finishes and adhesives in the case of industrial yarns and tire cord.

The absorption of water molecules into the yarn structure is promoted by reason of the fact that a vapor atmosphere also develops in the heating device itself.

The present invention preferably includes the steps of applying a drawing force to the advancing yarn as it passes through the heating chamber and which is sufficient to draw the advancing yarn. The invention rapidly achieves a yarn temperature of more than 80° C., which is necessary for drawing the yarn, and the temperature remains unchanged for a predetermined yarn path. Consequently, it becomes unnecessary to apply measures which in the case of the prior art are directed to arrange and establish the yield point in the inlet end of the heating zone.

In the present invention, the vapor blown onto the yarn material condenses on the still unheated yarn. The water condensing on the yarn has a temperature of about 100° C.

Also, in the heating chamber itself a vapor atmosphere is produced.

A further advantage results in that the heating of the yarn in the heating chamber occurs in a very protective manner. The yarn is not subjected right from the beginning to the temperature of the heating zone, but is first heated very rapidly, though to only about 100° C., until its water jacket has totally evaporated. The above function is based on the fact that the vapor exiting from the nozzle and impacting upon the unheated yarn condenses on the surface of the yarn, thereby transferring to the yarn in particular its heat of condensation. As a result a film of water deposits on the surface of the yarn.

The invention further provides that the water vapor penetrates the yarn which, as is known, comprises a plurality of individual filaments combined to a bundle, over the entire cross section of the yarn or filament bundle. This is accomplished by directing the water vapor onto the yarn in a direction transverse to its direction of advance. The advantage of this procedure lies in that the filaments undergo a displacement, thereby simultaneously being brought from a parallel uniform position to an entangled position. This leads to a kind of intermingling, which produces a cohesion between the filaments of the filament bundle that becomes thus a consolidated yarn.

In the known method, draw forces are applied to the yarn, in that a very high air friction is generated by the very high yarn speed. The fact that with the present invention, the water vapor is preferably directed onto the yarn in a direction transverse to its advance, reduces the resulting air friction and, thus, the necessary speed.

The invention permits the yarn to advance in the heating chamber, while contacting an elongate heating element, or in a noncontacting manner at a predetermined distance from an elongate heating element and its heated surface. Due to the film of water, which surrounds the yarn as same enters into the heating chamber, it is possible to heat the heating element to a temperature above the melting point of the yarn. In this instance, the film of water prevents a very sudden heating of the yarn and damage. Instead of guiding the yarn in a noncontacting or contacting manner, the yarn may also be advanced at a slight distance along a heated heating element and its heated surface by yarn guides, which are distributed along the heating zone, substantially evenly spaced apart.

Subsequent to the vapor treatment in combination with a wetting by water, the yarn advances in accordance with the invention through an elongated heating chamber and is heated therein to the desired temperature. The advantage of the invention lies in that on the one hand the yarn is heated very rapidly to about 100° C., and enters into the heating chamber already in a heated condition, but maintains on the other hand in the heating chamber likewise a temperature of about 100° C., until the water film condensed on the yarn surface has totally evaporated. This means that the yarn is treated in the heating chamber in a protective manner. This is important especially when the synthetic filament yarn is drawn, since the still undrawn yarn is very sensitive, in particular to heat. As a result of limiting the temperature to 100° C. in the inlet region of the heating chamber, it is also possible to subject the yarn to drawing in this inlet region, i.e., the drawing occurs there automatically. After the water film has evaporated, the yarn assumes a higher temperature, which is favorable for its further treatment, full orientation, as well as crystallization.

Since the film of water is applied by means of heated vapor, the yarn is already preheated, when it enters into the heating chamber. This allows additional heat to be applied in the heating chamber slowly. For this reason, a noncontacting heating is advantageous. On the other hand, the film of water surrounding the yarn in a partial region of the heating chamber allows temperatures to be applied, which lead per se to damage of the yarn, in particular temperatures above the melting point. The use of such a high-temperature heater allows the length of the heating zone to be shortened. However, it is also possible to cause the yarn to contact a heating element in the heating zone.

To apply the heat uniformly, it is advantageous to use a heater, in which the yarn is guided, in part without contacting, and in part in contact with the heating surfaces. This can be achieved primarily by a heater with an elongate heating surface, on which several yarn guides are arranged, which have the function of guiding the yarn at a distance from the heating surface, but which also are themselves in contact with the heated surface, thereby assuming its heat and transferring same to the yarn (note, for example, U.S. Pat. No. 5,148,666).

The treatment of yarn by a vapor nozzle is known per se. The known nozzles are used individually, and are especially useful, so as to break down inner tensions in the yarn. Likewise known from DE-AS 16 60 605 is a yarn treatment, in which the vapor treatment is followed by a further heat treatment in an elongate heating zone for the purpose of setting the yarn. In this treatment, however, only very small forces are applied, and in particular the vapor nozzle is separated a considerable distance from the inlet end of the heating zone. It can therefore be assumed that the applied vapor does not enter into the heating zone, and that the film of water applied to the yarn by condensation will evaporate in the air passage between the vapor nozzle and the heating zone. This prior teaching is therefore unsuitable, in particular for operating in the heating zone with temperatures which are above the melting point of the polymer. The combination of a vapor nozzle with a heater directly adjacent thereto is not known.

Another advantage of the apparatus of the present invention is that a complex yarn treatment requires only a heating device consisting of a nozzle and a heating chamber, and in particular that a subsequent heated godet is not needed.

As pointed out above, the advantages of the method and apparatus of the invention become effective especially during the drawing of the yarn. On the one hand, the yield point is locally stabilized in the vapor nozzle. On the other hand, a very rapid heating results to the temperature that is needed for drawing. Finally, a heating to a higher temperature than required is very protective. For these reasons, the method is applied primarily with a drawing operation.

In addition, in the shrinkage or relaxation treatment, important advantages result from the fact that it is an at least two-stage treatment, in which the yarn is subjected first to a temperature of about 100° C. and then to another, preferably higher temperature. This allows the shrinkage treatment, in which the residual shrinkage of the yarn in removed or reduced, to be combined with the setting treatment.

BRIEF DESCRIPTION OF THE DRAWINGS

Some of the objects and advantages of the present invention having been stated, others will appear as the description proceeds, when considered in conjunction with the accompanying drawings, in which.

DETAILED DESCRIPTION OF THE PREFERRED EMBODIMENTS

Figure 1:
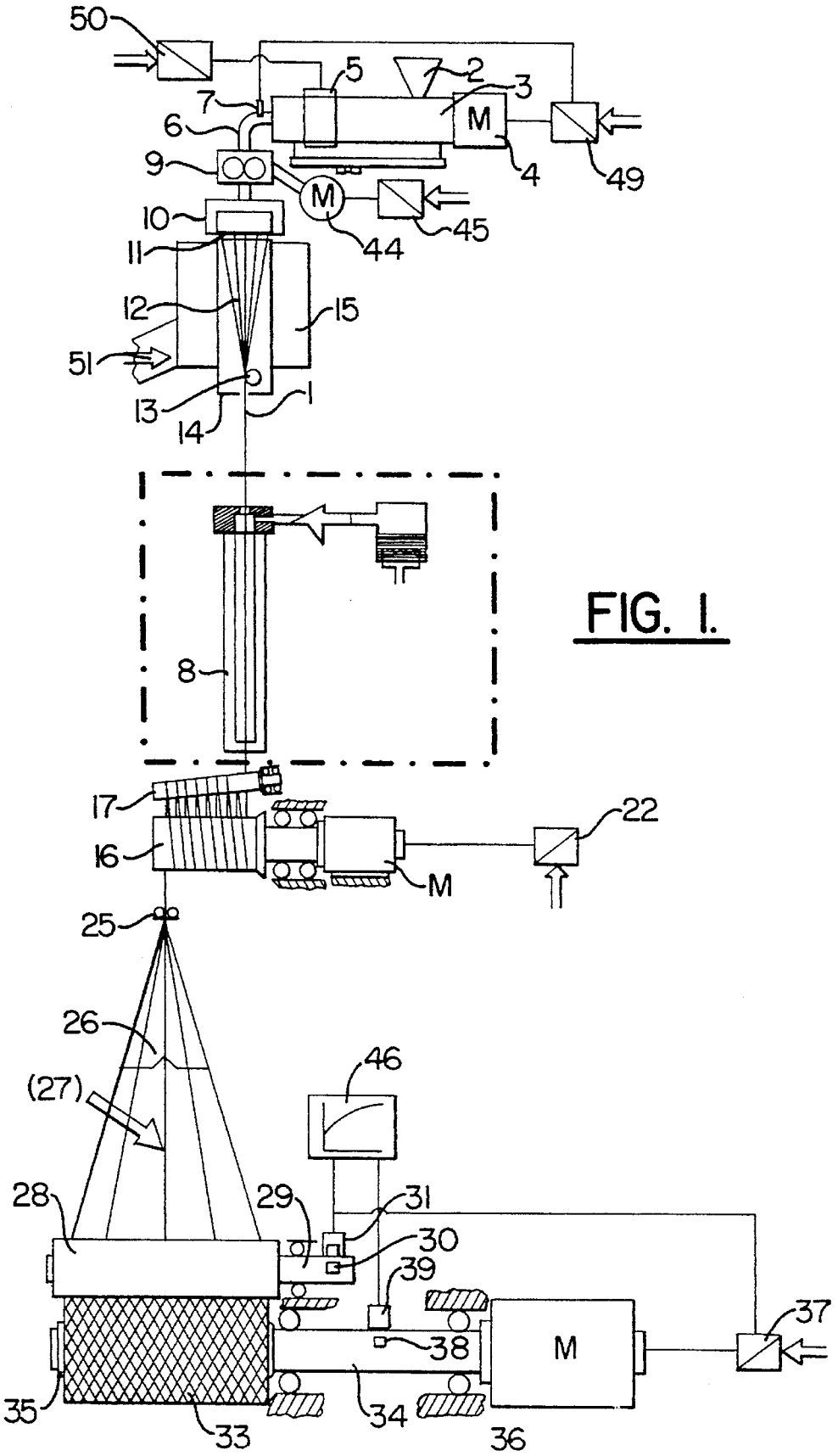
FIG. 1 is a schematic view of the primary components of a melt spinning process and apparatus which embodies the present invention.
Figure 2:
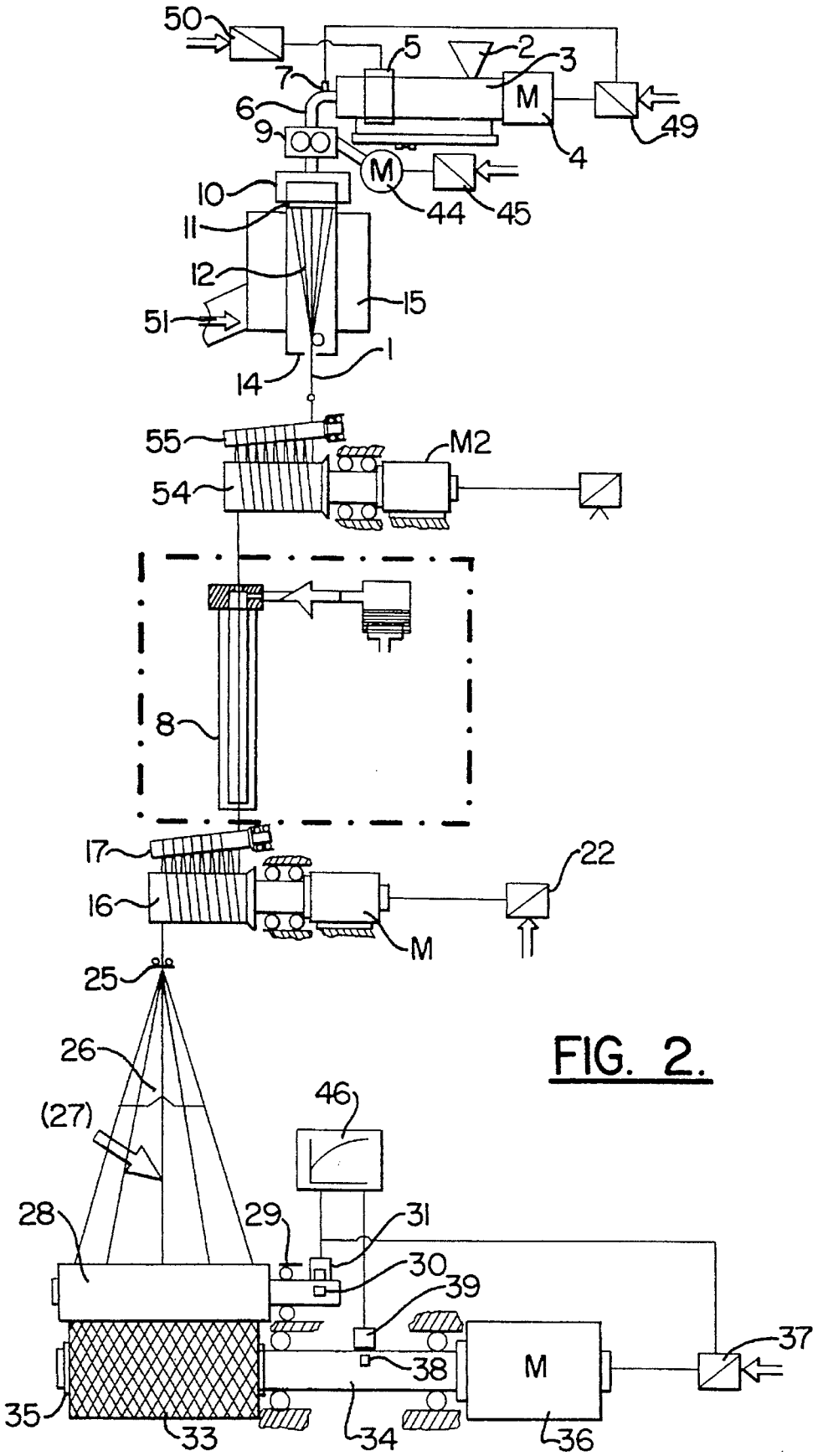
FIG. 2 is a schematic view of a modified embodiment of the method and apparatus of the present invention.

Common to the embodiments shown in FIGS. 1 and 2 is that a yarn 1 is spun from a thermoplastic material. The thermoplastic material is supplied through a hopper 2 to an extruder 3. The extruder 3 is driven by a motor 4, which is controlled by a control unit 49. In the extruder 3, the thermoplastic material is melted. The work of deformation (shearing energy), which is applied by the extruder to the material, assists in the melting process. In addition, a heater 5, for example, in the form of a resistance heater, is provided, which is controlled by a control unit 50. Through a melt line 6, which includes a pressure sensor 7 for measuring the melt pressure so as to control the pressure and speed of the extruder, the melt reaches a gear pump 9, which is driven by a pump motor 44. The pump motor 44 is controlled by a control unit 45, so as to permit a very fine adjustment of the pump speed. Pump 9 transports the melt flow to a heated spin box 10, the underside of which mounts a spinneret 11. From the spinneret 11, the melt emerges in the form of fine strands of filaments 12. The filament strands 12 advance through a perforated cooling shaft 14 which is surrounded by a housing 15. The housing 15 receives an air current 51 which is directed through the perforated shaft 14 and crosswise or radially to the web of filaments 12, thereby cooling the filaments.

At the outlet end of the cooling shaft 14, the web of filaments is combined by an applicator roll 13 to a yarn 1 and provided with a liquid spin finish.

Referring now to the embodiment of FIG. 1, the yarn is withdrawn from cooling shaft 14 and from spinneret 11 by a godet 16. The yarn loops about godet 16 several times. To this end, a guide roll 17 is used which is arranged so as to be axially inclined relative to godet 16. The guide roll 17 is freely rotatable. The godet 16 is driven by a motor M and a frequency changer 22 at an adjustable speed. This withdrawal speed is by a multiple higher than the natural exit speed of the filaments 12 from the spinneret 11.

Referring now to the embodiment of FIG. 2, the yarn is withdrawn from cooling chamber 14 and from spinneret 11 by a godet 54. The yarn loops several times about godet 54. To this end a guide roll 55 is used, which is axially inclined relative to the godet 54. The guide roll 55 is freely rotatable. The godet 54 is driven by a motor M2 at an adjustable speed. This withdrawal speed is by a multiple higher than the natural exit speed of the filaments 12 from the spinneret. From the godet 54, the yarn advances through a heating chamber 8 to a further godet 16, which is referred to as a draw roll in the present embodiment. The draw roll 16 is driven at a higher speed than the above-described godet 54. As a result, the yarn is drawn between the two godets 54 and 16.

From draw roll 16 of FIG. 2 or godet 16 of FIG. 1, the yarn 1 advances to a so-called "apex yarn guide" 25, and thence to a traversing triangle 26. The yarn is traversed by a conventional yarn traversing mechanism 27, which comprises for example two oppositely rotating blades that reciprocate the yarn 1 over the length of a package 33. In so doing, the yarn loops about a contact roll 28 downstream of yarn traversing mechanism 27. Contact roll 28 lies against the surface of the package 33, which is formed on a tube 35. The tube 35 is clamped on a winding spindle 34. The spindle 34 is driven by a motor 36 and a control unit 37, so that the surface speed of package 33 remains constant. To this end and for use as a control variable, the speed of the freely rotatable contact roll 28 is sensed on the contact roll shaft 29 by means of a ferromagnetic insert 30 and a magnetic pulse generator 31.

It should be noted that the yarn traversing mechanism 27 may also be a standard cross-spiralled roll with a yarn guide traversing in a groove over the range of traverse.

In FIG. 1, as a parameter of the state of the package 33, its diameter or a quantity derived therefrom is continuously measured. To measure the diameter, the speed of the spindle 34 and the speed of the contact roll 28 resting against the surface of the package, are measured. To this end, ferromagnetic inserts 38, 30 are employed which are mounted on the spindle 34 and on the contact roll 28, respectively, as well as corresponding pulse generators 39, 31. Whereas the speed of the contact roll 28 is used simultaneously as a control value for adjusting the spindle motor 36 via the spindle control unit 37, the speed of the spindle 34, which is not described in more detail, is used for controlling the yarn traversing mechanism 27.

In the embodiment of FIG. 1, the heating chamber 8 is arranged between cooling chamber 14 and the godet 16. In the embodiment of FIG. 2, the heating chamber 8 is located between the godet 54 and the draw roll 16.

Figure 3:
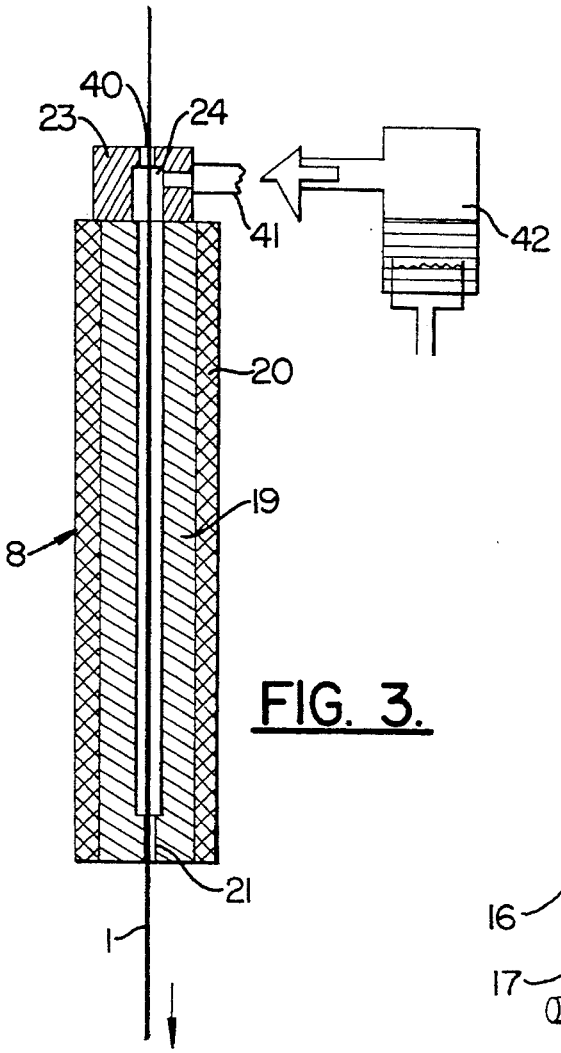
FIG. 3 is a sectional view of a yarn heating apparatus which embodies the present invention.

Referring now to FIG. 3, an embodiment of the heating chamber 8 is illustrated in more detail. As illustrated, the heating chamber 8 comprises an elongate tubular housing 19, which is surrounded by a heating jacket 20. The heating jacket 20 consists of a resistance wire surrounded by heat insulating material. The housing 19 can be heated by means of the heating jacket, preferably to a temperature higher than 180°, and possibly higher than 300° C. The yarn 1 advances through the housing 19 in its axial direction. Arranged at the outlet end is a narrow exit passageway 21, and arranged at the inlet end is a vapor nozzle 23. The vapor nozzle 23 possesses a yarn channel 24, which is concentric to the yarn channel in the housing 19, and which terminates directly in the yarn channel of housing 19. At its inlet end, the vapor nozzle is closed by a narrow entry passageway 40. The vapor nozzle 23 receives hot vapor through a vapor duct 41, which terminates in the yarn channel 24 of the vapor nozzle perpendicularly to the yarn axis (i.e. its advancing direction), or transversely to the yarn axis with a flow component directed against the direction of the advancing yarn. As a result, the yarn is impacted by a hot vapor jet. The hot vapor is produced in a hot vapor generator 42, which is shown only schematically without the necessary control and measuring instruments for temperature and pressure. A hot water vapor is produced with a temperature of, for example, 300° C. The vapor jet impacting upon the yarn causes the filaments of the yarn to initially entangle, resulting in a kind of intermingling of the filaments. Such interminglings occur primarily in knots at certain controllable distances. These interminglings effect a cohesion of the filaments. Thus, the application of the vapor jet effects the formation of a yarn insofar as it improves the cohesion of the individual filaments. Furthermore, the vapor jet, which impacts at this point upon an already considerably cooled yarn, causes the water vapor to condense on the yarn, and to thus transfer its heat of condensation. As a result, the yarn or the individual filaments are intimately penetrated by the water vapor on the one hand, and heated very rapidly to a temperature of about 100° C. on the other hand. This is a favorable temperature for drawing. Consequently, the yarn will flow already in the inlet region of heater housing 19 in the meaning of a drawing, while the further heating zone serves to restructure the molecules and to perform a crystallization.

The heating surface of the chamber 8 may take the form of an elongate U-shaped or V-shaped plate, with the yarn being guided to advance in the longitudinal groove thereof without contacting the same. Also, the yarn may be guided along the heating surface by one or several short guide members, which are spaced along the length of the heating surface.

In the heating chamber of FIG. 3, the vapor nozzle 23 is arranged directly adjacent the inlet end of the heating chamber. In this instance, the yarn channel 24 of the vapor nozzle communicates directly with the yarn channel of the heating chamber, thereby developing in the heating chamber a very pure water vapor atmosphere, which has the effect of a protective gas atmosphere and prevents the yarn from oxidizing.

When the yarn enters into the heating chamber, it is necessary that the applied film of water first evaporate. In the illustrated embodiment, the heating chamber is heated, preferably to very high temperatures, which are above the melting point, i.e., essentially to more than 220° C. However, it should be noted that lower temperatures are likewise possible. In any event, the film of water ensures that, as long as it remains undrawn, the yarn is not exposed to the high temperature of the heating chamber. This will occur only when the water jacket has evaporated. However, it is then also ensured that the initial drawing of the yarn has occurred already. The yarn is then no longer temperature-sensitive to any particular extent, so that it can temporarily withstand also temperatures, which are above the melting point. As already described above, this allows to attain not only a more favorable yarn treatment, but it is also possible to shorten the heating device considerably.

Figure 5:
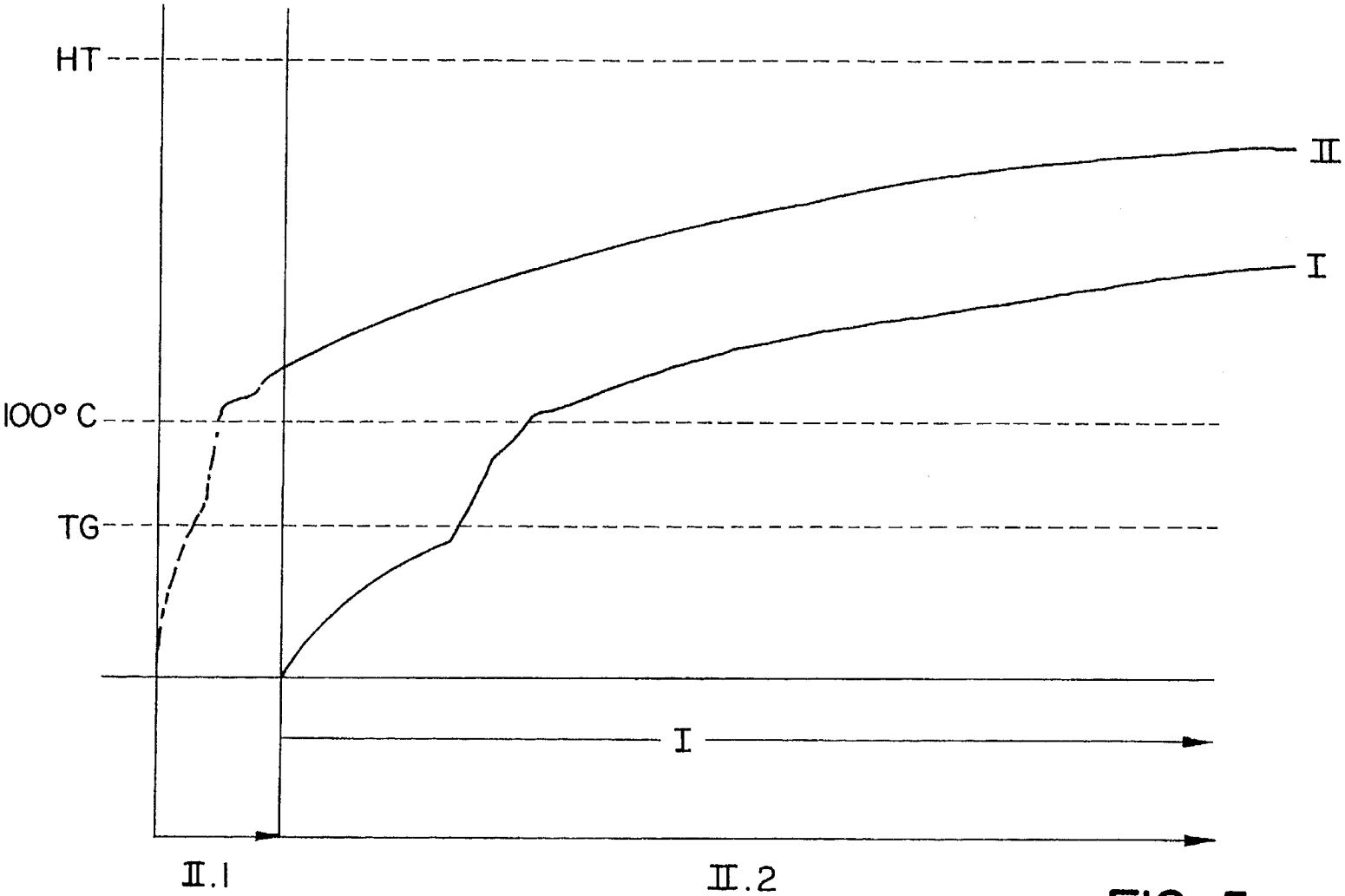
FIG. 5 is a diagram illustrating a comparison of the temperature of a yarn being heated in accordance with the prior art and in accordance with the invention.

FIG. 5 illustrates a temperature curve as is typical of the heating device in accordance with the invention. Plotted on the ordinate is the temperature and on the abscissa the path covered by the yarn, and compared with the temperature curve in a heating zone without a preceding vapor nozzle. The path and the temperature curve in such a conventional heating zone is indicated at I. It shows that the temperature increases first hyperbolically to the first-order point of transition (TG). Then, a drawing occurs, during which work of deformation is performed, and the temperature of the yarn is increased very considerably. Subsequently, the heating follows again a hyperbolical course. The yarn path with a preceding vapor nozzle is indicated at II.1 in the vapor nozzle and at II.2 in the subsequent heating zone. In the vapor nozzle, the vapor condenses first on the unheated yarn, thereby transferring its heat of condensation to the yarn. As a result, the yarn temperature increases very rapidly to the first-order point of transition (TG). At this point, the yarn starts to flow due to the drawing forces, and the work of deformation is converted likewise to heat. As a result, the yarn reaches very rapidly the temperature of 100° C. When the yarn has reached this temperature, it is heated hyperbolically in the subsequent heating zone. It can be seen that the heating occurs not only substantially faster, but also a higher temperature is reached over the same distance.

Figure 4:
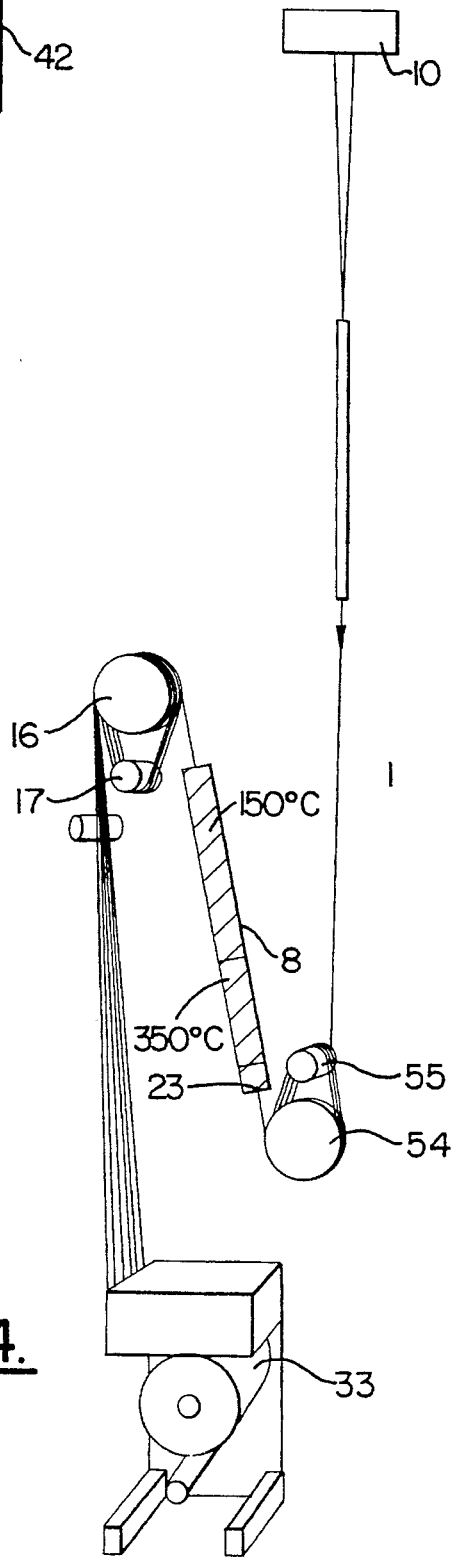
FIG. 4 is a schematic view of another yarn processing apparatus which embodies the present invention.

Shown in FIG. 4 is a method of producing polypropylene yarns. Several yarns 1 are spun from a spin beam 10 be and withdrawn by the godet, 54 and the guide roll 55. To this extent, the method corresponds to that of FIG. 2. The godet 54 is followed by a second godet 16 with a guide roll 17, before the yarns are wound to a package 33.

Arranged between godets 54 and 16 is a heating device e of the present invention. Accordingly, the heating device 8 comprises the vapor nozzle 23 and the downstream heating tube. This heating tube is divided into two zones, which can be heated independently of one another.

In the illustrated embodiment, the polypropylene yarn is spun with a filament denier of 0.7 to 3 dtex, and withdrawn from the spinneret at a speed between 3,500 and 4,500 m/min., while being heated in the heating chamber to 100°to 140° C., and drawn. The godet 16 has a circumferential speed which is higher than that of godet 54. The yarn is drawn at a ratio of about 1:1.3. The first zone of the heating tube is heated to 350° C., and the second zone to 150° C. This allows to achieve between godets 54 and 16 not only an adequate drawing, but also an adequate relaxation treatment, which continues even to the takeup zone. It is possible to assist in the relaxation, in that the second godet 16 is likewise heated.

This method has proven that the vapor treatment at the beginning of the heat treatment results in that during the drawing of the highly partially oriented polypropylene yarn, a recovery of the molecular structure occurs at the same time, so that the residual shrinkage of the yarn is reduced very substantially. To this end, the standard methods will require an additional step, which is included between further godets.

It should be pointed out that, contrary to standard methods, in which all godets for withdrawing, drawing, and relaxing the polypropylene yarn are heated, the godet 54 is unheated, and that it is likewise not necessary to heat godet 16.

In the drawings and the specification, there have been set forth preferred embodiments of the invention and, although specific terms are employed, the terms are used in a generic and descriptive sense only and not for the purpose of limitation, the scope of the invention being set forth in the following claims.

What is claimed is:

1. A method of producing a synthetic filament yarn comprising the steps of extruding a polymeric material so as to form a plurality of advancing filaments, gathering the extruded filaments so as to form an advancing yarn, guiding the advancing yarn through an elongate heating chamber, and applying heated water vapor to the advancing yarn immediately prior to its entry into the heating chamber so that the water vapor condenses on the yarn as it enters into the heating chamber.

2. The method as defined in claim 1 wherein the step of applying heated water vapor to the advancing yarn includes directing the water vapor onto the yarn in a direction transverse to its direction of advance.

3. The method as defined in claim 1 wherein the step of applying heated water vapor to the advancing yarn includes directing the water vapor onto the yarn in a direction having a component which is opposite to its direction of advance.

4. The method as defined in claim 1 wherein the step of guiding the advancing yarn through an elongate heating chamber includes guiding the yarn so as to not contact the heating chamber.

5. The method as defined in claim 1 wherein the heating chamber has a surface temperature greater than the melting temperature of the polymeric material of the yarn.

6. The method as defined in claim 5 wherein the temperature of the surface of the heating chamber is at least about 300° C.

7. The method as defined in claim 1 comprising the further step of applying a drawing force to the advancing yarn as it passes through the heating chamber and which is sufficient to draw the advancing yarn.

8. The method as defined in claim 7 wherein the water vapor is heated so as to have a temperature of at least about 100° C. as it is applied to the yarn.

9. The method as defined in claim 8 wherein the step of applying heated water vapor to the advancing yarn results in the development of a water vapor atmosphere in the heating chamber.

10. An apparatus for producing a synthetic filament yarn comprising means for extruding a polymeric material so as to form a plurality of advancing filaments, means for gathering the extruded filaments so as to form an advancing yarn, an elongate heating chamber and means for guiding the advancing yarn therethrough, and means for applying heated water vapor to the advancing yarn immediately prior to its entry into the heating chamber so that the water vapor condenses on the yarn as it enters into the heating chamber.

11. The apparatus as defined in claim 10 further comprising means for applying a drawing force to the yarn as it advances through the heating chamber.

12. An apparatus for heating an advancing synthetic yarn comprising an elongate heating chamber having an inlet opening and an outlet opening and so as to permit a yarn to be advanced therethrough, means for heating the heating chamber so as to heat a yarn which is advanced therethrough, and means located immediately adjacent said inlet opening of said heating chamber for applying heated water vapor to a yarn advancing therethrough and so that the water vapor condenses on the yarn as it enters into the heating chamber.

13. The apparatus as defined in claim 12 wherein said means for applying heated water vapor to a yarn comprises a vapor nozzle having an outlet end which is contiguous to said inlet opening of said heating chamber.

14. The apparatus as defined in claim 13 wherein said heating chamber comprises a tubular member positioned to surround the path of the advancing yarn without contacting the same.

15. The apparatus as defined in claim 13 wherein said vapor nozzle is constructed and configured so as to direct the water vapor onto the yarn in a direction transverse to its direction of advance.

16. The apparatus as defined in claim 15 wherein said means for applying heated water vapor to a yarn further comprises means for heating the water vapor to a temperature of at least about 100° C.

* * * * *